US010395583B1

(12) United States Patent
Dylewski

(10) Patent No.: US 10,395,583 B1
(45) Date of Patent: Aug. 27, 2019

(54) DRIVING A DISPLAY FOR PRESENTING ELECTRONIC CONTENT

(71) Applicant: Amazon Technologies, Inc., Seattle, WA (US)

(72) Inventor: Scott Michael Dylewski, San Francisco, CA (US)

(73) Assignee: Amazon Technologies, Inc., Seattle, WA (US)

( * ) Notice: Subject to any disclaimer, the term of this patent is extended or adjusted under 35 U.S.C. 154(b) by 265 days.

(21) Appl. No.: 15/417,526

(22) Filed: Jan. 27, 2017

(51) Int. Cl.
*G09G 3/20* (2006.01)
*G09G 3/34* (2006.01)

(52) U.S. Cl.
CPC ..... *G09G 3/2018* (2013.01); *G09G 3/344* (2013.01); *G09G 3/3446* (2013.01); *G09G 2320/0257* (2013.01); *G09G 2380/14* (2013.01)

(58) Field of Classification Search
CPC ..... G09G 3/2018; G09G 3/344; G09G 2320/0257; G09G 2380/14; G09G 3/3446
See application file for complete search history.

(56) References Cited

U.S. PATENT DOCUMENTS 8,803,794 B1 * 8/2014 Froment ..... G09G 3/2085 345/107
2011/0187684 A1 * 8/2011 Amundson ..... G09G 5/00 345/204
2011/0221730 A1 * 9/2011 Nishizawa ..... G06F 3/03545 345/211
2014/0176614 A1 * 6/2014 Rosenberg ..... G09G 3/344 345/690

* cited by examiner

*Primary Examiner* — Temesghen Ghebretinsae
*Assistant Examiner* — Sosina Abebe
(74) *Attorney, Agent, or Firm* — Lee & Hayes, P.C.

(57) ABSTRACT

This disclosure is directed to methods, apparatuses, and systems for providing driving signals to present electronic content on an electronic display. The electronic display may include an electronic paper display that utilizes electronic ink to render the electronic content. An electronic signal can be generated by a display controller to drive individual pixels to a black state, a white state, or a gray state in-between the black state and the white state. In some instances, the display controller can provide a first driving signal to set a pixel to a target state, followed by turning a power off for the display. After a predetermined amount of time, a second driving signal can be provided to drive the pixel to the target state, without changing the target state of the pixel.

20 Claims, 6 Drawing Sheets

DRIVING A DISPLAY FOR PRESENTING ELECTRONIC CONTENT

BACKGROUND

A large and growing population of users is enjoying entertainment through the consumption of digital content items (or simply "content items"), such as music, movies, images, electronic books, and so on. The users employ various electronic devices to consume such content items. Among these electronic devices are electronic book (eBook) reader devices, cellular telephones, personal digital assistants (PDAs), portable media players, tablet computers, netbooks, and the like. As the quantity of available electronic media content continues to grow, along with increasing proliferation of devices to consume that media content, finding ways to enhance user experience continues to be a priority. For example, in the context of an eBook reader device, a positive user experience may include quick page turns, increased contrast between black and white pixels, and reduced ghosting.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Figure 1:
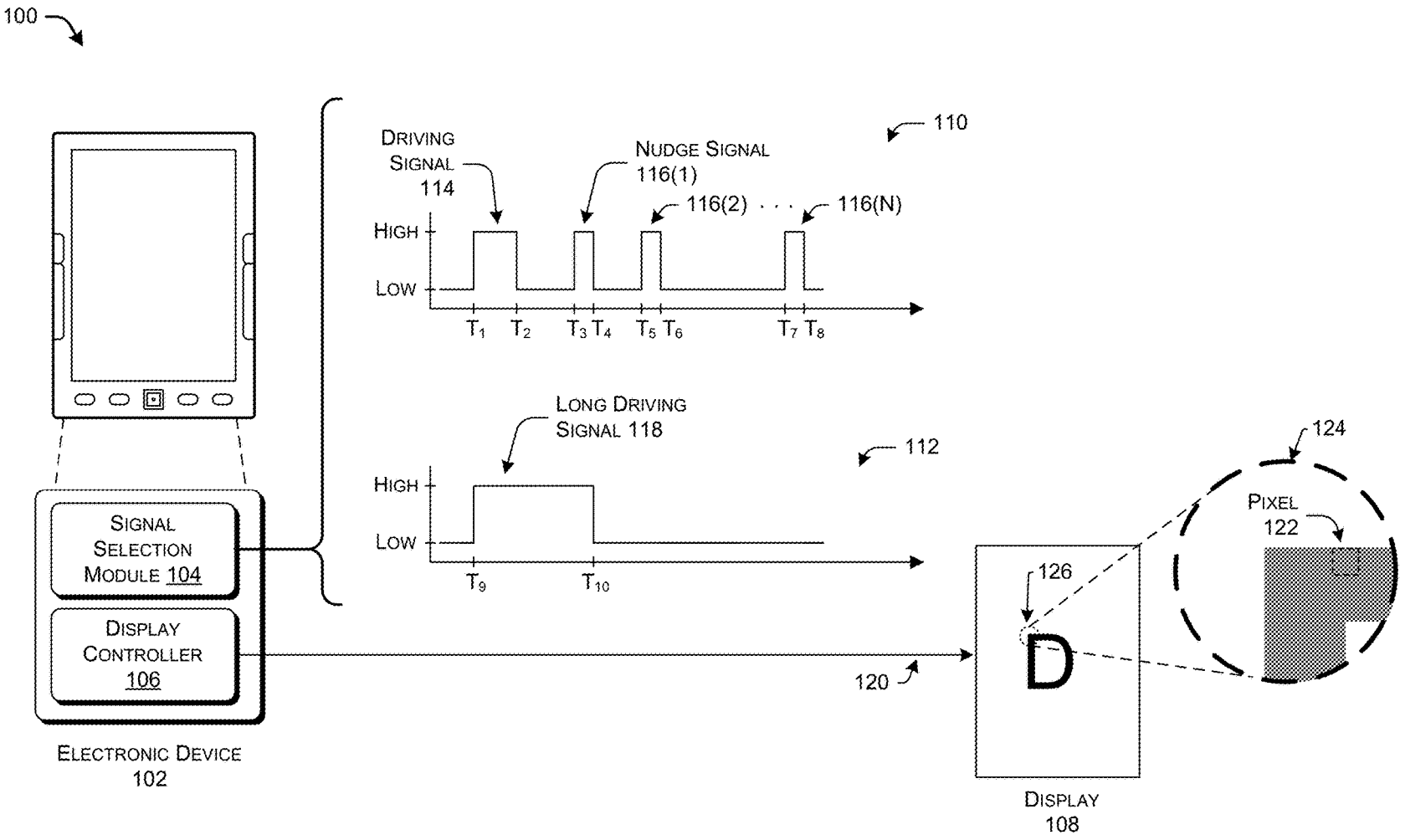
FIG. 1 shows an example of illustrative signals for driving a pixel to display electronic content on an electronic device.

This disclosure describes methods, apparatuses, and systems for providing driving signals to present electronic content on an electronic display. For example, the electronic display may include an electronic paper display that utilizes electronic ink to render content for display. An electronic signal can be generated by a display controller to drive individual pixels to a black state, a white state, or a gray state that is in-between the black state and the white state. In general, as an amount of time driving a pixel towards a black state (also referred to simply as black) or towards a white state (also referred to simply as white) increases, a quality of the displayed content can improve, such as increased contrast, reduced ghosting, etc. However, as an amount of time driving a pixel to black or white increases, a user experience may be degraded, for example, waiting for a page of content to change from a current page to a next page. On the other hand, as an amount of time driving a pixel to black or white decreases, a quality of content to be presented can be degraded, for example, due to reduced contrast, ghosting, etc. In some instances, an electronic signal can be provided to drive pixels that use a first driving signal to set a pixel to a target state or target state, followed by turning a power off for the display. After a predetermined amount of time, a second driving signal can be provided to drive the pixel to the target state, without changing the target state of the pixel. Thus, the present disclosure can reduce an amount of time for providing page turns in electronic paper displays, while reducing unwanted artifacts such as ghosting.

As used herein, the target state of a pixel (e.g., a target pixel state) may correspond to a grayscale value or color value of a pixel to display electronic content. For example, based on electronic content to be display, a target state of a pixel may correspond to a grayscale value or a color. As used herein, a pixel may include one or more electrodes that apply voltage and/or current to electronic ink to display a particular grayscale value or a color. Further, as used herein, an electronic signal or a driving signal may correspond to a series of voltages over time applied to an electrode of a pixel to cause the pixel to display a particular grayscale value or a color.

An electronic device may selectively apply long driving signals and short driving signals based at least in part on a selection or setting defined by a user, a selection or setting defined by content to be displayed, an interaction with the electronic device, a type of content to be displayed, etc. For example, a user may specify or otherwise indicate (e.g., in a user profile) a selection for the short driving signals, which may allow a user to quickly change content, for example, while flipping pages in electronic content. By way of another example, electronic content may be associated with particular signals for rendering content, such that particular content or particular pixels of content can be rendered using a signal defined by a content provider, for example. Further, a signal can be selected based at least in part on an interaction by a user with the electronic device, such as an indication to rapidly turn pages, for example. In some instances, the electronic device may enter a quick signal mode when receiving a number of requests to change content within a threshold amount of time. In some instances, the electronic device may enter a quick signal mode when receiving a request to change content before a rendering of content is complete under another signal mode (e.g., a signal mode using a long driving signal). In some instances, a signal can be selected based on a previous state of a pixel (e.g., in a white state or black state) and a current or next state (e.g., a white state or black state). These and other examples are described herein.

In some instances, a quick signal mode may include the short driving signal including a first signal and a second signal. For example, the quick signal mode may include a turning power on to an electronic paper display, providing a first driving signal to drive a pixel to a target state, and then turning power off to the electronic display. After a predetermined amount of time, the electronic paper display may turn power back on, and may provide a second driving signal that can be shorter in duration than the first driving signal to drive the same pixel to the same target state. Thus, by turning power off between the first driving signal and the second driving signal, the electronic device can receive a request or interrupt from a user to render different content, for example, to turn a page from a current page (rendered at least in part via the first driving signal) to a next page. In such an interrupt event, the second driving signal would not be utilized to render the target pixel state associated with the current page, and instead, a new first driving signal would be utilized to render a pixel associated with the next signal.

Referring to the quick signal mode described above with respect to the first driving signal and the second driving signal, the first driving signal allows the electronic device to quickly render a pixel associated with content to be displayed, while allowing further content selection to occur (e.g., rapid page turning). In some instances, following the completion of the first driving signal and subsequent turning power off to the electronic display, the second signal can be utilized to maintain a state of the pixel to a target pixel state. The second driving signal can be a brief signal following the first driving signal, and may follow any predetermined amount of time after the first driving signal. Further, any number of second driving signals may follow the first driving signal.

As described herein, the first driving signal, the second driving signal (comprising the short driving signal), and the long driving signal applied to an electrode of a pixel may be described in connection with a digital logic states (e.g., a "high" state (corresponding to a positive or negative voltage) and a "low" state (corresponding to zero volts)), start/stop times for the respective signals, delay(s) between signals, etc. As may be understood in the context of this disclosure, the "high" state may correspond to any positive or negative voltage to drive an electrode of a pixel associated with an electronic display. As may be understood in the context of this disclosure, the electronic display may comprise a bistable display utilizing electronic ink that is responsive to positive and negative voltages. For example, an application of a positive voltage to a pixel electrode may cause the pixel to transition to a visible white state, while an application of a negative voltage to the pixel electrode may cause the pixel to transition to a visible black state. In some instances, a series of voltages alternating between a positive voltage and a negative voltage may cause the pixel to transition to a visible gray state.

In this manner, the methods, apparatuses, and systems described herein improve a functioning of a computing device by allowing for faster rendering of electronic content, and improving a quality of rendered content. For example, by providing faster rendering of electronic content, a user may more quickly browse electronic content, such as quickly turning pages of an electronic book. By providing a quick signal as described herein, with a first driving signal and a second driving signal, unwanted artifacts such as ghosting can be reduced by driving pixels to a target value. Further, pixel drift can be reduced over time by driving pixels to a target value. Increasing a rate of changing content on an electronic display (e.g., page turns) and increasing a quality of rendered content (e.g., reducing ghosting) further improves a user experience of the content presented to a user. These and other aspects described herein contribute to improvements to the functioning of a computing device and a user experience.

The methods, apparatuses, and systems described herein can be implemented in a number of ways. Example implementations are provided below with reference to the following figures.

FIG. 1 shows an example 100 of illustrative signals for driving a pixel to display electronic content on an electronic device. An electronic device 102 may include a signal selection module 104 operating in conjunction with a display controller 106 to render electronic content on a display 108 of the electronic device 102.

The signal selection module 104 may include functionality to select a short driving signal 110 and a long driving signal 112. As described herein, the short driving signal 110 may include a driving signal 114, and one or more nudge signals 116(1), 116(2), . . . , 116(N). Further, the long driving signal 112 may include a long driving signal 118. The driving signal 114 and the long driving signal 112 illustrate logical signal levels (e.g., not voltages).

As described herein, the display controller 106 may be communicatively coupled to the display 108 via a communication bus 120. In some instances, the communication bus 120 may be communicatively coupled to one or more addressable pixels of the display 108, such as a pixel 122. In some instances, the display 108 may include a decoder to decode an address of a target pixel and apply a particular signal to a particular pixel of the display 108. As illustrated in FIG. 1, a detail 124 including the pixel 122 is provided showing a detail of a region 126 of the display 108.

Turning to the short driving signal 110, the short driving signal 110 may include the driving signal 114 and the one or more nudge signals 116(1), 116(2), . . . , 116(N) (also referred to as a nudge signal 116). In some instances, the short driving signal 110 may correspond to a driving signal output by the display controller 106 to drive one pixel of the display 108, such as the pixel 122. In some instances, the driving signal 114 may include a "high" signal (e.g., a logical signal representing a series of positive voltages over time, a series of negative voltages over time, or a series of alternative positive and negative voltages over time) from $T_1$ to $T_2$, which is subsequent in time to $T_1$. In some instances, an amount of time between $T_1$ to $T_2$ may be on the order of 250 milliseconds (ms). In some instances, the driving signal 114 may drive a pixel from white to black, from black to white, from white to gray, from black to gray, from gray to gray, etc. At $T_1$, the display 108 may turn on, and at $T_2$, the display 108 may turn off. Between $T_2$ and $T_3$, which is subsequent in time to $T_2$, the electronic device 102 may remain in an off state (at least in terms of the display 108). In some instances, a display that is in an off state (or where power is turned off to a display) may correspond to a display where no signals (e.g. no current or voltage) are provided to drive pixels to a particular value.

The nudge signal 116(1) may correspond to a high signal between $T_3$ and $T_4$. For example, at $T_3$, the display 108 may turn on, while at $T_4$, which is subsequent in time to $T_3$, the display 108 may turn off again. The nudge signal 116(1) may contain information or may otherwise control a particular pixel to a same state as indicated in the driving signal 114. That is, in some instances, the nudge signal 116(1) works to maintain a state of the pixel 122, without changing the target pixel state. However, in some instances, the nudge signal 116(1) may change a state of the pixel from a previous target value (e.g., black) to another value (e.g., gray).

In some instances, the time between $T_2$ and $T_3$ may depend on temperature, a pixel state or level (e.g., white, black, or gray), etc. In some instances, the time between $T_2$ to $T_3$ may depend on a time between $T_1$ to $T_2$, may depend on a voltage corresponding to the "high" signal state, may depend on an area under the curve (corresponding to a voltage and a time between $T_1$ to $T_2$), etc.

In some instances, after the display controller 106 outputs the nudge signal 116(1), the display 108 may shut off and a predetermined amount of time may occur between $T_4$ and $T_5$, which is subsequent in time to $T_4$, after which, the nudge signal 116(2) may occur. In some instances, the time between the first nudge signal (116(1)) and the second nudge signal (116(2)) may be a same time period as a time between the driving signal 114 and the nudge signal 116(1). That is, in some instances, a period of time between $T_2$ and $T_3$ may be a same period of time as the time period between $T_4$ and $T_5$. Following the second nudge signal 116(2), the display controller 106 may output any number of nudge signals, such as the nudge signal 116(N), occurring between $T_7$ and $T_8$. In some instances, $T_7$ is subsequent in time to $T_6$, and $T_8$ is subsequent in time to $T_7$.

In some instances, a number of nudge signals 116 output by the display controller 106 may be limited to prevent overdriving of the pixels. For example, in some instances, a cumulative area under the curve (AUC) of the driving signal 114 and any nudge signals 116(1), 116(2), . . . , 116(N), may correspond to an AUC of the long driving signal 118. In some instances, the AUC of the short driving signal 110 is longer than the AUC of the long driving signal 112, and vice versa.

In some instances, the time of a nudge signal 116 (e.g., the "high" signal of the nudge signal 116) may be on the order of 10 ms. In some instances, all nudge signals 116 may be a same amount of time, and in some instances, the nudge signal 116 may vary in time between nudge signals. In some instances, a time of a nudge signal 116 may be shorter than a time of the driving signal 114. In some instances, a "high" level of the nudge signal 116 may be a same voltage or level as a "high" level of the driving signal 114. In some instances, any number of nudge signals 116 may be used, and in some instances, a number of nudge signals 116 can be limited (e.g., to a threshold number of nudge signals) to prevent overdriving the pixel 122, for example, as discussed above. In some instances, a duration of the nudge signal 116 may be a smallest duration possible to drive a pixel from the display controller 106. That is, if a minimum signal duration is 5 ms or 10 ms, then the duration of the nudge signal 116 would be 5 ms or 10 ms, respectively.

Turning to the long driving signal 118, the long driving signal 118 may represent a high signal from $T_9$ until $T_{10}$, which is subsequent to $T_9$. In some instances, a duration of the long driving signal 118 (e.g., a time between $T_9$ to $T_{10}$) may be on the order of 450 ms. In some instances, the duration of the long driving signal 118 is longer than the duration of the driving signal 114. In some instances, the long driving signal 118 may be selectively used instead of the driving signal 114, and vice versa. Further, in some instances, the signal selection module 104 may select between the short driving signal 110 and the long driving signal 112. For example, a first subset of pixels of the display 108 may be driven with the long driving signal 112, while a second subset of pixels may be driven with the short driving signal 110.

In some instances, a request to change content rendered on the display 108 cannot be performed during the application of a signal to drive a pixel. That is, if a request to change a page from a current page to a next page, for example, is received at a time between $T_1$ and $T_2$, the request may be delayed, queued, or may not be processed until a time after $T_2$ (but before $T_3$). Similarly, if a request to change a page is received at a time between $T_9$ and $T_{10}$, the request may not be processed until a time after $T_{10}$. Thus, in some instances, by having the driving signal 114 with a shorter duration than the long driving signal 118, a page turn or a change of electronic content can be initiated, processed, completed, etc. faster or earlier in time using the driving signal 114 of the present disclosure.

In some instances, pixel values (or colors) may correspond to white, black, or gray. In some instances, a pixel may take one of 16 shades of gray. That is, a pixel value of 0 may correspond to white, 15 may correspond to black, while a number between 0 and 15 may correspond to a gray value. Although discussed generally with regards to black and white, it may be understood that any colors may be used in the context of this disclosure. Further, although a pixel rendering 16 shades of gray is given, any number of shades of gray may be utilized herein.

The signal selection module 104 may select a signal to apply to a particular pixel based on a variety of factors. For example, the signal selection module 104 may apply the short driving signal 110 to pixels that are all white (e.g., a value of 0) or to pixels that are all black (e.g., a value of 15). In some instances, a selection may be based on being above a threshold (e.g., above 10) or below a threshold (e.g., below 5). In some instances, the signal selection module 104 may selectively apply signals to the pixels based on being above or below a darkness threshold or above or below a lightness threshold. For example, in a case where the a pixel may take one of 16 shades of gray, a lightness threshold may correspond to a grayscale level (e.g., 5) below which pixels with a target state below the lightness threshold may be white or light gray. Similarly, the darkness threshold may correspond to a grayscale level (e.g., 10) above which pixels with a target state above the darkness threshold may be black or dark gray. Thus, pixels with a target pixel state below a lightness threshold (e.g., white or light gray) and pixels with a target pixel state above a darkness threshold (e.g., black or dark gray) may have the short driving signal applied thereto, while pixels above the lightness threshold and below the darkness threshold (e.g., in the middle) may have the long driving signal applied thereto. Said differently, for example, the signal selection module 104 may not apply a short driving signal to a gray pixel, but may selectively apply the short driving signal to a black pixel or a white pixel. It may be understood in the context of this disclosure that any values or thresholds are within the scope of this disclosure.

In some instances, the signal selection module 104 may select a signal based at least in part on a selection or setting of a user or a network device. For example, a user may select in a user profile associated with the user or associated with the electronic device 102 that the user prefers a quick signal mode. In some instances, a network device (e.g., described in connection with FIG. 2) may indicate or control the electronic device 102 to use the quick signal mode. In some instances, a user interaction with the electronic device 102 may cause the electronic device 102 to enter a quick signal mode. For example, if a user is attempting to flip through pages in an electronic document, or is changing content at a rate above a threshold value (e.g., 2 page turns in one second, for example), the signal selection module 104 may enter a quick signal mode and may select the short driving signal 110 as discussed herein.

Further, in some instances, the signal selection module 104 may select a signal for a particular pixel based at least in part on a previous state of a pixel and a current state of the pixel. For example, a short driving signal 110 may be applied to pixels with a previous state of black and a current state (e.g., a target state) of white, to reduce ghosting. Further, the signal selection module 104 may select a signal for a particular pixel based least in part on a state of adjacent or neighboring pixels. For example, a short driving signal 110 may be selected for pixels on a boundary between black and white to increase contrast.

Figure 2:
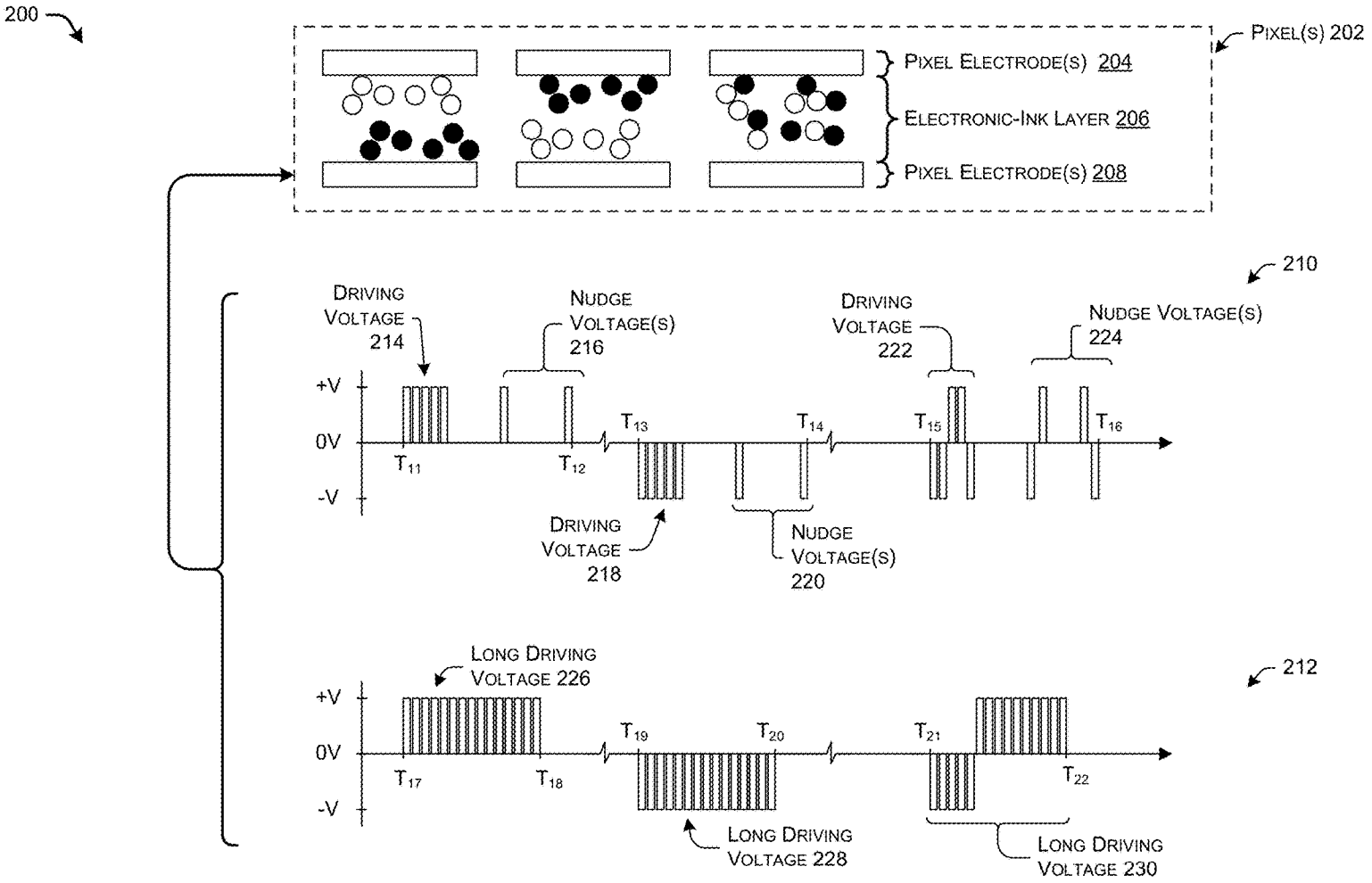
FIG. 2 shows an example of illustrative voltages being applied to one or more pixel electrodes for driving a pixel to display electronic content on an electronic device.

FIG. 2 shows an example 200 of illustrative voltages being applied to one or more pixel electrodes for driving a pixel to display electronic content on an electronic device.

One or more pixels 202 comprise one or more pixel electrodes 204, one or more electronic-ink layers 206, and one or more pixel electrodes 208. In some instances, individual pixels of the one or more pixels 202 may have individual pixel electrodes 204 and 208 associated therewith. In some instances, the electronic-ink layer 206 may include microcapsules for each pixel, and may include charged particles having a black color and a white color, respectively. In some instances, as various electrical charges are applied to the pixel electrodes 204 and 208, the electronic-ink layer 206 for each individual pixel may transition to display a color associated with the voltages applied to the pixels 202.

Exemplary voltages are provided in voltage diagrams 210 and 212. In one example from time $T_{11}$ to time $T_{12}$, a time subsequent to $T_{11}$, a driving voltage 214 comprising a series of voltages over time (e.g., illustrated as a positive voltage (+v)) may be applied to an electrode of a pixel to cause the pixel to transition to a target pixel state (e.g., a grayscale value or a color value to be displayed by a pixel). Following the driving voltage 214, one or more nudge voltages 216 may be applied to the electrodes of the pixel to maintain the target state of the pixel. In some instances, the driving voltage 214 and the one or more nudge voltages 216 comprise an example of a short driving signal.

In another example from time $T_{13}$ to time $T_{14}$, a time subsequent to $T_{13}$, a driving voltage 218 comprising a series of voltages over time (e.g., illustrated as a negative voltage (−v)) may be applied to an electrode of a pixel to cause the pixel to transition to a target pixel state (e.g., a grayscale value or a color value to be displayed by a pixel). Following the driving voltage 218, one or more nudge voltages 220 may be applied to the electrodes of the pixel to maintain the target state of the pixel. In some instances, the driving voltage 218 and the one or more nudge voltages 220 comprise an example of a short driving signal.

In another example from time $T_{15}$ to time $T_{16}$, a time subsequent to $T_{15}$, a driving voltage 222 comprising a series of voltages over time (e.g., illustrated as both positive voltages and negative voltages) may be applied to an electrode of a pixel to cause the pixel to transition to a target pixel state (e.g., a grayscale value or a color value to be displayed by a pixel). As illustrated, the driving voltage 222 may include positive and/or negative voltages to drive the pixel to a target state between white and black (e.g., gray). Following the driving voltage 222, one or more nudge voltages 224 may be applied to the electrodes of the pixel to maintain the target state of the pixel. In some instances, the driving voltage 222 and the one or more nudge voltages 224 comprise an example of a short driving signal. As may be understood in the context of this disclosure, any combination of positive and/or negative voltages may be included as the driving voltage 222 and/or the nudge voltages 224.

Turning to the voltage diagram 212, an example is given of a long driving voltage 226 from time $T_{16}$ to time $T_{17}$, a time subsequent to $T_{16}$, illustrating a series of voltages over time (e.g., illustrated as a positive voltage (+v)) applied to an electrode of a pixel to cause the pixel to transition to a target pixel state (e.g., a grayscale value or a color value to be displayed by a pixel). In some instances, the long driving voltage 226 comprises an example of a long driving signal.

In another example from time $T_{19}$ to time $T_{20}$, a time subsequent to $T_{19}$, a long driving voltage 228 comprising a series of voltages over time (e.g., illustrated as a negative voltage (−v)) may be applied to an electrode of a pixel to cause the pixel to transition to a target pixel state (e.g., a grayscale value or a color value to be displayed by a pixel). In some instances, the long driving voltage 228 comprises an example of a long driving signal.

In another example from time $T_{21}$ to time $T_{22}$, a time subsequent to $T_{21}$, a long driving voltage 230 comprising a series of voltages over time (e.g., illustrated as both positive voltages and negative voltages) may be applied to an electrode of a pixel to cause the pixel to transition to a target pixel state (e.g., a grayscale value or a color value to be displayed by a pixel). As illustrated, the long driving voltage 230 may include positive and/or negative voltages to drive the pixel to a target state between white and black (e.g., gray). In some instances, the long driving voltage 230 comprises an example of a long driving signal.

Figure 3:
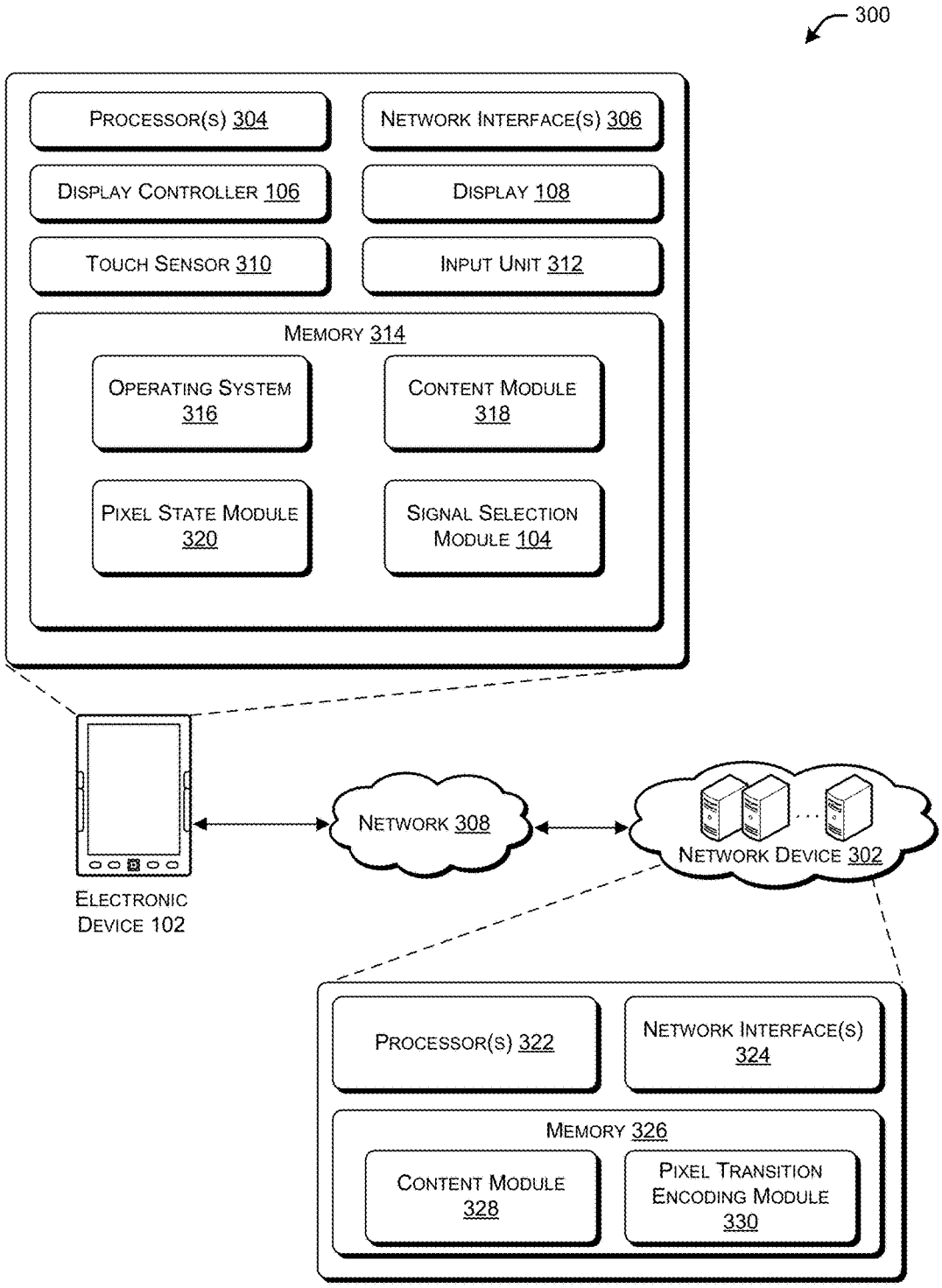
FIG. 3 shows an illustrative architecture including an electronic device and a network device for generating content and dynamically driving pixels for displaying electronic content.

FIG. 3 shows an illustrative architecture 300 including the electronic device 102 and a network device 302 for generating content and dynamically driving pixels for displaying electronic content. In some instances, the electronic device 102 may comprise any type of mobile electronic device (e.g., a laptop computer, a tablet computing device, an electronic reading device (e.g., an electronic book (eBook) reader device), a multifunction communication device, a portable digital assistant (PDA), a mobile phone, a smartphone, a gaming console, etc.) or non-mobile electronic device (e.g., a desktop computer, a television, etc.). In addition, while FIG. 3 illustrates several example components of the electronic device 102, it is to be appreciated that the electronic device 102 may also include other conventional components, such as system busses, input/output components, and the like.

In various embodiments, the electronic device 102 includes one or more processors 304 and one or more network interfaces 306. The processor(s) 304 may include any one or more central processing units or graphic processing units. The network interface(s) 306 may support both wired and wireless connection to a network 308 and various other networks, such as cellular networks, radio, Wi-Fi networks, short range networks (e.g., Bluetooth, LoRa, Zigbee, etc.), infrared, and so forth.

The electronic device 102 also includes one or more displays 108 and corresponding display controllers 106. The one or more displays 108 may represent a variety of displays, including but not limited to light emitting diode (LED) displays, liquid crystal displays (LCDs), cathode-ray tube (CRT) displays, projection displays, electronic paper displays and/or other displays having similar display properties to those described herein.

Electronic paper displays represent an array of display technologies that largely mimic the look of ordinary ink on paper. In contrast to conventional backlit displays, electronic paper displays typically reflect light, much as ordinary paper does. In addition, electronic paper displays are often bistable, meaning that these displays are capable of holding text or other rendered images even when very little or no power is supplied to the display.

In one implementation, an electronic paper display (e.g., the display 108) comprises an electrophoretic display that moves particles between different positions to achieve different grayscale values. For instance, in a pixel that is free from a color filter, the pixel may be configured to produce white when the particles within this pixel are located at the front (i.e., viewing) side of the display. When situated in this manner, the particles reflect incident light, thus giving the appearance of a white pixel. Conversely, when the particles are pushed near the rear of the display, the particles absorb the incident light and, hence, cause the pixel to appear black to a viewing user. In addition, the particle may be situated at varying locations between the front and rear sides of the display 108 to produce varying shades of gray.

Of course, while one example has been given, it is to be appreciated that the electronic paper displays described herein may comprise any other type of electronic paper technology, such as gyricon displays, electrowetting displays, electrofluidic displays, interferometric modulator displays, cholestric liquid crystal displays, and the like. In addition, while some of the displays described below are discussed as rendering black, white, and varying shades of gray, it is to be appreciated that the described techniques apply equally to electronic paper displays capable of rendering color pixels. As such, the terms "white", "gray", and "black" may refer to varying degrees of color in implementations utilizing color displays. For instance, where a pixel includes a red color filter, a "gray" value of the pixel may correspond to a shade of pink while a "black" value of the pixel may correspond to a darkest red of the color filter.

The display controller(s) 106 may each be associated with a display 108 of the electronic device 102, an operating system of the electronic device 102, and/or applications of the electronic device 102. The display controller(s) 106 may include hardware and/or software components configured to interface with and control the display(s) 108. In some instances, the display controller(s) 106 may implement, entirely or in part, the presentation techniques and signals described herein.

In various embodiments, the electronic device 102 includes one or more touch sensors 310. In some instances, at least one touch sensor 310 resides underneath or on top of a corresponding display 108 to form a touch-sensitive display that is capable of both accepting user input and rendering content corresponding to the input. In other instances, the electronic device 102 may include a touch sensor 310 that is adjacent to the display 108. It is to be appreciated that each of the techniques described below may apply to instances where the touch sensor 310 and the display 108 form a touch-sensitive display 108 and instances where the sensor 310 and the touch-sensitive display 108 do not form such a display.

The touch sensor 310 may comprise a capacitive touch sensor, an interpolating force sensitive resistance (IFSR) sensor, or any other type of touch sensor. In some instances, the touch sensor 312 is capable of detecting touches as well as determining an amount of pressure or force of these touches. For instance, the touch sensor 310 may comprise an ISFR sensor resident behind a display 108, such that a user is able to draw upon the display 108 utilizing a writing instrument, such as a stylus, a finger of the user, or the like.

In some instances, the electronic device 102 may further include an input unit 312 in addition to the touch sensor 310. The touch sensor 310 is to be understood as one possible type of input unit 312. Other input units 312 may include keyboards, key pads, computer mice, joysticks, video cameras (e.g., for gesture-based inputs), microphones (e.g., for audio input and/or voice-based commands), etc. The input units 312 may include any input mechanism.

Depending on the configuration of the electronic device 102, the memory 314 (and other memories described throughout) is an example of computer-readable storage media and may include volatile and nonvolatile memory. Thus, the memory 314 may include, but is not limited to, RAM, ROM, EEPROM, flash memory, or other memory technology, or any other medium which can be used to store media items or applications and data which can be accessed by the electronic device 102.

In various embodiments, the memory 314 may be used to store an operating system 316. In some instances, the operating system 316 may be any sort of operating system. The operating system 316 may interface with the display controller(s) 106 to provide content stored in a content module 318 on the display(s) 108 as well as instructions for controlling the displaying and transitioning of content. In some embodiments, the operating system 316 includes drivers for interfacing with hardware components of the display controller(s) 106. In some embodiments, drivers of the operating system 316 for interfacing with the display 108 may invoke a pixel state module 320 and the signal selection module 104 to generate and display content and/or transitions on the display 108.

In general, content to be presented by the electronic device 102 is stored in the content module 318. When a user is navigating within various pages of the content, the user may provide an indication to the electronic device 102 to transition from a current page to a target page. For the purposes of this discussion, the current page may correspond to the page/portion of electronic content that is currently being displayed via the display(s) 108. The target page may correspond to the page/portion of the electronic content that is to be subsequently displayed via the display(s) 108, such as a previous page/portion of the electronic content, a next page/portion of the electronic content, or any other page/portion of the electronic content.

In some instances, when navigation from a first page to a second page, for example, the display controller 106 may return all pixels to a known state, such as all white or all black. Thus, a transition from a first page to a second page may include providing a signal to render a pixel corresponding to the first page, receiving a selection of the second page, providing a signal to render the pixel to a black state or white state (e.g., a baseline or known state), and providing a signal to render the pixel corresponding to the second page.

In some instances, the pixel state module 320 may compare a first state of a pixel associated with a current page and a second state of the pixel associated with a target page. For example, the current pixel state may be white, black, or some gray value. Further, the target pixel state may be white, black, or some gray value. The pixel state module 320 may determine a current pixel state and a target pixel state for some or all of the pixels of the display 108 provide the determination to the signal selection module 104. Further, the pixel state module 320 may determine states of pixels relative to adjacent pixels presented in a same display 108 (e.g., within a same page of electronic content).

Aspects of the signal selection module 104 are provided above with respect to FIG. 1. In general, the signal selection module 104 may select or determine a signal to drive a particular pixel based on a target pixel state and other factors. For example, the signal selection module 104 may receive a determination from the pixel state module 320 and may select a signal based at least in part on that determination. In some instances, the signal selection module 104 may operate in conjunction with the display controller 106 as described herein to drive pixels to display content in an efficient manner In some instances, the content module 318 may include text, graphics, audio, backgrounds, images, videos, animations, tables, etc., which represent content to be displayed or otherwise presented on the electronic device 102. In some instances, content in the content module 318 may be included in or associated with other electronic content, such as an electronic book, a graphic novel, an electronic comic book, an interactive illustrated book, a movie, an animation, etc. The network device 302 may provide content to the electronic device 102, either automatically or in response to a request from the electronic device 102.

In some instances, as the electronic device 102 receives indications to navigate from page to page of an electronic book, for example, a page that is a current page may be updated to indicate that the current page at a first time is a previous page at a later time.

The memory 314 may further include one or more applications, including user-level applications of a platform of the electronic device 102 and third party applications. The applications may include one or more modules for generating and/or providing content for display. The modules of the applications may provide the content to a driver of the operating system 316.

In various embodiments, the operating system 316 receives indications from drivers associated with the touch sensors 310 or the input unit 312 of input associated with manipulation a page of content and/or to navigate within and between pages of content. For example, a user may touch the display 108, making a sliding or swiping gesture with the user's fingers that is associated with a navigation to another page. In some instances, a user may swipe directly on content (e.g., within a table, or on a video) to navigate within (and/or to invoke transitions within) the content.

In some instances, the input unit 312 may receive an indication that the user is navigating to another page or within a particular content layer (e.g., a table) via a navigation button, via directional arrows, or via a joystick. In response to receiving the indication, the operating system 316 may invoke the various modules to apply one or more signals to render content in accordance with the disclosure.

In some instances, the electronic device 102 may have features or functionality in addition to those that FIG. 3 illustrates. For example, the device 102 may also include additional data storage devices (removable and/or non-removable) such as, for example, magnetic disks, optical disks, or tape. The additional data storage media may include volatile and nonvolatile, removable and non-removable media implemented in any method or technology for storage of information, such as computer readable instructions, data structures, program modules, or other data. In addition, some or all of the functionality described as residing within the device 102 may reside remotely from the device 102 in some implementations. In these implementations, the device 102 may utilize the network interface(s) 306 to communicate with and utilize this functionality.

In various embodiments, the electronic device 102 is connected via a network 308 to the network device 302. The network 308 may include any one or more networks, such as wired networks, wireless networks, and combinations of wired and wireless networks. Further, the network 308 may include any one or combination of multiple different types of public or private networks (e.g., cable networks, the Internet, wireless networks, etc.). In some instances, the electronic device 102 and the network device 302 communicate over the network 308 using a secure protocol (e.g., https) and/or any other protocol or set of protocols, such as the transmission control protocol/Internet protocol (TCP/IP).

Also, in further instances, the network device 302 may comprise one or more computing devices, and each computing device may each be or include a server or server farm, multiple, distributed server farms, a mainframe, a work station, a personal computer (PC), a laptop computer, a tablet computer, a personal digital assistant (PDA), a cellular phone, a media center, an embedded system, or any other sort of device or devices. In one implementation, the computing device(s) of the network device 302 represent a plurality of computing devices working in communication, such as a cloud computing network of nodes. When implemented on multiple computing devices, the network device 302 may distribute the modules and data 328 and 330 of the network device 302 among the multiple computing devices. In some implementations, one or more of the computing device(s) of the network device 302 represent one or more virtual machines implemented on one or more computing devices.

In some embodiments, the computing devices of the network device 302 include processor(s) 322 and network interface(s) 324. The processor(s) 322 may be or include any sort of processing units, such as central processing units (CPU) or graphic processing units (GPU). The network interface(s) 324 allow the devices of the network device 302 to communicate with one or both of the electronic device 102 and other devices. The network interface(s) 324 may send and receive communications through one or both of the network 308 or other networks. The network interface(s) 324 may also support both wired and wireless connection to various networks.

Depending on the configuration of the computing device(s) of the network device 302, the memory 326 (and other memories described throughout) is an example of computer-readable storage media and may include volatile and nonvolatile memory. Thus, the memory 326 may include, but is not limited to, RAM, ROM, EEPROM, flash memory, or other memory technology, or any other medium which can be used to store media items or applications and data which can be accessed by the network device 302. In various embodiments, the memory 326 may be used to store a content module 328 and a pixel transition encoding module 330.

In some instances, the content module 328 may correspond with the content module 318 in the electronic device 102. For example, the network device 302 may generate or aggregate content to be provided to the electronic device 102 in a format such that the electronic device 102 may apply rendering signals in accordance with the disclosure. In some instances, the content module 328 may include text, graphics, audio, backgrounds, images, videos, animations, tables, etc. In some instances, content in the content module 328 may be included in or associated with other electronic content, such as an electronic book, an electronic comic, an interactive illustrated book, etc. The network device 302 may provide content to the electronic device 102, either automatically or in response to a request from the electronic device 102.

In some instances, the pixel transition encoding module 330 may include functionality to receive electronic content and determine and/or generate individual transitions (signals) for pixels associated with the content. For example, the pixel transition encoding module 330 may receive an electronic book, for example, and may determine one or more sections, chapters, pages, etc. of the book where it is likely where a user may rapidly flip between pages of content. For example, the pixel transition encoding module 330 may assign a short driving signal or a long driving signal to content as a whole, sections of content (e.g., chapters, sections, etc.), or to individual pixels of the content. In some instances, selecting a signal may be based in part on a type of content (e.g., video, text, image, etc.), a size of content, color differences between a current page and a target page, preferences of an author or provider of the content, processing power of an electronic device presenting the content, etc. In some instances, the pixel transition encoding module 330 may operate in conjunction with the content module 328 so that the content may be provided to the electronic device 102. In some instances, the pixel transition encoding module 330 may determine and/or include a darkness threshold and/or a lightness threshold with electronic content to be transmitted to the electronic device 102. For example, the darkness threshold and the lightness threshold may be encoded into the electronic content by a network device providing the electronic content to an electronic device including the bistable display.

In some instances, the computing device(s) of the network device 302 may have features or functionality in addition to those that FIG. 3 illustrates. For example, the computing device(s) of the network device 302 may also include additional data storage devices (removable and/or non-removable) such as, for example, magnetic disks, optical disks, or tape. The additional data storage media may include volatile and nonvolatile, removable and non-removable media implemented in any method or technology for storage of information, such as computer readable instructions, data structures, program modules, or other data. In addition, some or all of the functionality described as residing within the computing device(s) of the network device 302 may reside remotely from the computing device(s) of the remote service 302, in some implementations. In these implementations, the computing device(s) of the network device 302 may utilize the network interface(s) 324 to communicate with and utilize this functionality.

FIGS. 4-7 illustrate example processes in accordance with embodiments of the disclosure. Each process described herein is illustrated as a logical flow graph, each operation of which represents a sequence of operations that can be implemented in hardware, software, or a combination thereof. In some instances, the order in which the operations are described is not intended to be construed as a limitation, and any number of the described operations can be combined in any order and/or in parallel to implement the process. In the context of software, the operations represent computer-executable instructions stored on one or more computer-readable media that, when executed by one or more processors, perform the recited operations. Generally, computer-executable instructions include routines, programs, objects, components, data structures, and the like that perform particular functions or implement particular abstract data types.

Figure 4:
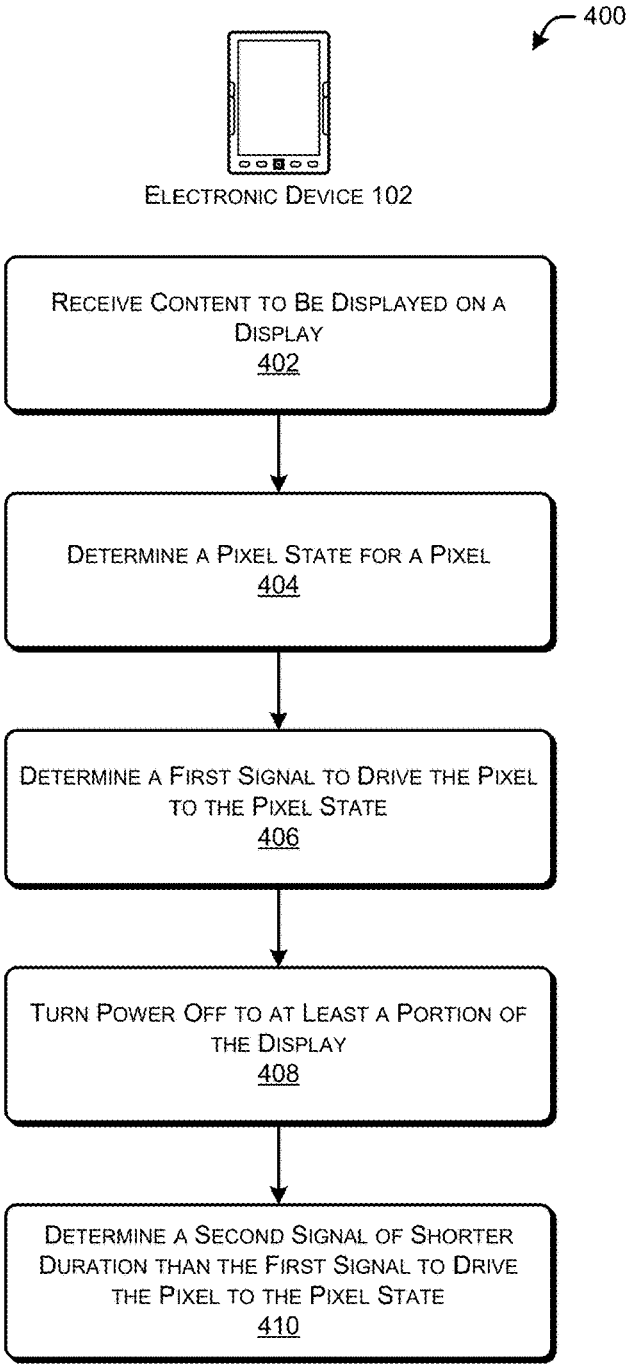
FIG. 4 illustrates a process for driving a pixel using a first signal and a second signal.

FIG. 4 illustrates a process 400 for driving a pixel using a first signal and a second signal. For example, aspects of the process 400 can be performed by the electronic device 102 of FIG. 1.

At 402, the operation may include receiving content to be displayed. For example, content may be received at the electronic device 102 from the network device 302 via the network 308. In some instances, the operation 302 can include receiving a selection of content by a user to be displayed on a display. In some instances, the operation 402 can include receiving an indication to turn a page of an electronic book from a current page to a target page, for example.

At 404, the operation may include determining a pixel state for a pixel. For example, the operation 404 may include determining an address of a pixel (e.g., an x/y address or a unique address associated with the pixel) and the state of the pixel to be presented for display. In some instances, a state of a pixel may correspond to a color intensity, RGB value, or a gray scale value (e.g., between 0 and 15, as discussed above). In some instances, the operation may include determining a current state of a pixel and a target state of a pixel to be displayed.

At 406, the operation may include determining a first signal to drive the pixel to the pixel state. For example, the first signal may correspond to the driving signal 114 of FIG. 1. In some instances, the operation 406 may include determining a "high" signal and duration to be applied to the particular pixel to drive the pixel to the target pixel state. In some instances, the operation 406 may include applying the first signal to the pixel to drive the pixel to the pixel state. In the case of an electronic paper display, the operation 406 may include applying a voltage (e.g., positive 5 volts, positive 15 volts, negative 5 volts, negative 15 volts, etc.) to the pixel to cause the pixel to transition to the target pixel state.

At 408, the operation may include turning power off to at least a portion of the display. For example, an electronic paper display (e.g., the display 108) may maintain a state of the display 108 even in an absence of power being supplied to a particular pixel and/or to the entire display 108. In some instances, the operation 408 may include turning power off to the pixel portion of the display 108 while continuing to supply or maintaining power to one or more touch sensors associated with a display 108 of the device 102.

At 410, the operation may include determining a second signal of a shorter duration than the first signal to drive the pixel to the pixel state. In some instances, the pixel in the operation 410 is the same pixel as referred to in the operation 404. Further, in some instances, the pixel state in the operation 410 is the same pixel state as referred to in the operation 406. In some instances, the operation 410 may include applying the second signal to the pixel to drive the pixel to maintain the state of the pixel. In some instances, the operation 410 may be repeated as necessary to maintain a state of the pixel at a target pixel state (e.g., repeated a regular intervals to refresh a target state of the pixel).

Figure 5:
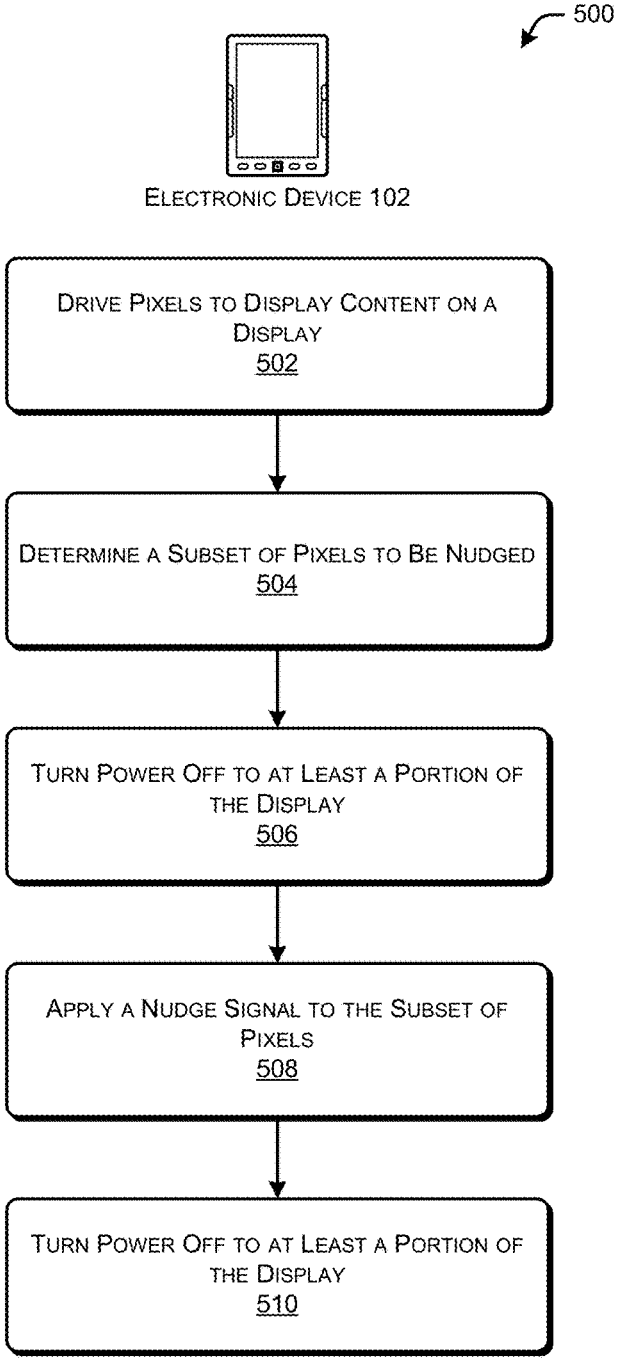
FIG. 5 illustrates a process for selectively applying a nudge signal to drive pixels associated with electronic content.

FIG. 5 illustrates a process 500 for selectively applying a nudge signal to drive pixels associated with electronic content. For example, aspects of the process 500 can be performed by the electronic device 102 of FIG. 1.

At 502, the operation may include driving one or more pixels to display content. For example, the operation 502 may include driving a display (e.g., the display 108) of pixels to display a page associated with an electronic book. In some instances, the operation 502 may include driving one or more pixels using a short driving signal or a long driving signal, as discussed herein.

At 504, the operation may include determining a subset of pixels to be nudged. In this context, the operation 504 may include determining one or more pixels to apply a nudge signal, such as the nudge signal 116 of FIG. 1. In some instances, the subset of pixels can be determined based on a current pixel state (e.g., white, black, or gray). In some instances, the subset of pixels can be determined based on a previous pixel state (e.g., white, black, or gray). In some instances, the subset of pixels can be determined based on differences or similarities between the current pixel state and a previous pixel state. For example, the subset of pixels may include some or all pixels that are currently white but previously were in a black state. In some instances, the subset of pixels may be determined based on threshold pixels values (e.g., all pixels above a gray scale value of 10, as described herein). In some instances, the subset of pixels can be determined based on adjacent pixels. For example, the subset of pixels can include pixels at a boundary of an edge of a shape (e.g., at a black/white interface) in contrast to pixels in an interior or a shape (e.g., with neighboring black pixels or neighboring pixels). In some instances, the subset of pixels can include pixels that are likely to include ghosting or other artifacts from presenting previous content.

At 506, the operation may include turning power off to at least a portion of the display. As discussed above, the operation may include not supplying power to maintain a state of pixels of the display, such as with an electronic paper display. In some instances, the operation 506 may include configuring the electronic device 102 in a state to accept additional input, such as to turn to a new page in an electronic book, or otherwise select new content for presentation.

At 508, the operation may include applying one or more nudge signals to the subset of pixels, such as the subset of pixels determined in the operation 504. In some instances, the operation 508 may include applying a nudge signal (such as the nudge signal 116) to individual pixels to drive the pixels to maintain a target state of the pixel. In some instances, the nudge signal may be applied to one or more pixels to slowly transition to another image or content displayed on the display.

At 510, the operation may include turning power off to a least a portion of the display. In some instances, the operation 410 can be substantially similar to the operation 506.

Figure 6:
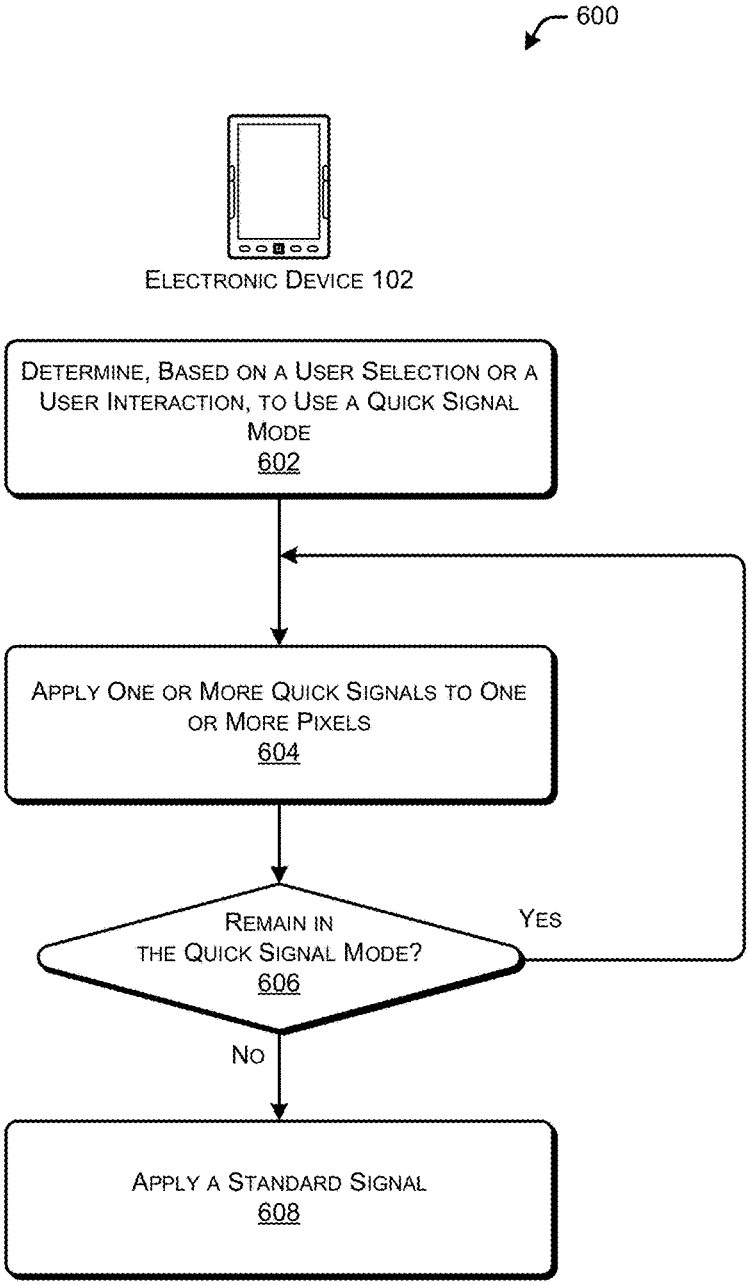
FIG. 6 illustrates a process for selectively applying quick signals based on user selection and/or user interaction.

FIG. 6 illustrates a process 600 for selectively applying quick signals based on user selection and/or user interaction. For example, aspects of the process 600 can be performed by the electronic device 102 of FIG. 1.

At 602, the operation may include determining, based at least in part on a user selection or a user interaction, to use a quick signal mode described herein. In some instances, the user selection may be made in connection with a user profile, or may be made in connection with a device profile associated with the electronic device 102. In some instances, the user interaction may include receiving one or more inputs to change or display content within a threshold amount of time. For example, if a user is rapidly scrolling through content, or if a user is rapidly changing pages, or if a user is changing a size of text thereby causing text to be rendered on a display, this may lead to a determination to enter the quick signal mode. In some instances, a default mode may be a long driving signal mode (e.g., utilizing the long driving signal 112), while a short driving mode may be associated with the quick signal mode (e.g., utilizing the short driving signal 110).

At 604, the operation may include applying one or more quick signals to one or more pixels of a display (e.g., the display 108) associated with the electronic device 102. In some instances, the quick signals may include driving a pixel with a first signal for a first period of time to a first pixel state, turning off the display for a predetermined period of time, and driving the pixel with a second signal for a second period of time to the first pixel state. In some instances, the second period of time is shorter than and subsequent to the second period of time. In some instances, the second signal can be referred to as a nudge signal.

At 606, the operation may include determining whether to remain in the quick signal mode. For example, the operation 606 may include determining that a user is continuing to scroll through content, is otherwise requesting that content be rendered on the display 108 at a rapid rate. In some instances, after entering the quick signal mode, the process 600 may stay in the mode for a predetermined amount of time, or until expressly requested by a user. In some instances, the electronic device 102 may remain in a quick signal mode based at least in part on a battery level or power level associated with a power source of the electronic device 102. For example, if an available amount of power is below a threshold the operation 606 may determine to change a signal mode.

At 606, if the operation determines to remain in the quick signal mode ("yes" in operation 606) then the processing may return to the operation 604 and may remain in the quick signal mode. If the operation 606 determines to not remain in the quick signal mode ("no" in operation 606) then the processing may continue to operation 608, where the device may apply a standard signal.

In the operation 608, the process may apply a long driving signal (e.g., the signal 112 of FIG. 1) to drive one or more pixels to present content on a display (e.g., the display 108) of an electronic device 102. In some instances, the operation 608 may include entering a standard signal mode where the electronic device 102.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A system comprising:

one or more processors; and one or more computer-readable media storing computer-executable instructions that, when executed by the one or more processors, cause the one or more processors to:

determine a first target pixel state for a pixel of a bistable display, the first target pixel state associated with a first electronic content to be presented on the bistable display;

apply a first voltage to an electrode associated with the pixel to transition the pixel to the first target pixel state;

cease an application of voltage to the bistable display upon the pixel reaching the first target pixel state;

apply a second voltage to the electrode associated with the pixel to maintain the pixel at the first target pixel state;

receive an input to navigate to a second electronic content;

determine a second target pixel state corresponding to the pixel, the second target pixel state presenting at least a portion of the second electronic content in the bistable display;

determine a difference between the first target pixel state and the second target pixel state; and select, based at least in part on the difference, a third voltage to apply to the pixel to transition the pixel to the second target pixel state.

2. The system of claim 1, wherein to apply the first voltage, the computer-executable instructions further cause the one or more processors to:

determine that the first target pixel state is above a darkness threshold and apply the first voltage having a first polarity; or determine that the first target pixel state is below a lightness threshold and apply the first voltage having a second polarity that is opposite the first polarity.

3. The system of claim 1, wherein the computer-executable instructions further cause the one or more processors to:

apply the second voltage to the electrode associated with the pixel following a predetermined amount of time following application of the first voltage; and apply a fourth voltage to the electrode associated with the pixel to maintain the pixel at the first target pixel state, the fourth voltage being applied to the electrode associated with the pixel following the predetermined amount of time.

4. The system of claim 1, wherein application of the second voltage to maintain the pixel at the first target state reduces ghosting associated with the pixel transitioning from a first value to a second value.

5. The system of claim 1, wherein the pixel is a first pixel, and wherein the computer-executable instructions further cause the one or more processors to:

determine that a second pixel of the bistable display is adjacent to the first pixel;

determine that the second pixel is to be set at a third target pixel state;

determine that the third target pixel state is below a darkness threshold and above a lightness threshold; and apply a fourth voltage to the second pixel based at least in part on the third target pixel state being below the darkness threshold and above the lightness threshold, wherein a first duration of the fourth voltage is longer than a second duration of the first voltage.

6. The system of claim 5, wherein the difference corresponds to the transition between a first state of the pixel presenting a white pixel associated with the first electronic content to a second state of the pixel presenting a black pixel associated with the second electronic content.

7. The system of claim 1, wherein the pixel is a first pixel, and wherein the computer-executable instructions further cause the one or more processors to:

apply the first voltage to the first pixel to transition the first pixel to the first target pixel state, the first voltage applied for a first duration;

determine that a second pixel of the bistable display is adjacent to a third pixel of the bistable display, the second pixel and the third pixel associated with presenting the first electronic content on the bistable display;

determine a third target pixel state associated with the second pixel;

determine a fourth target pixel state associated with the third pixel;

determine that the third target pixel state is a same as the fourth target pixel state;

apply a fourth voltage to the second pixel to drive the second pixel to the third target pixel state, the fourth voltage applied for a second duration; and apply a fifth voltage to an electrode associated with the fourth pixel to transition the third pixel to the fourth target pixel state, the fifth voltage applied for the second duration, wherein the second duration is longer than the first duration.

8. The system of claim 1, wherein the pixel is a first pixel, and wherein the computer-executable instructions further cause the one or more processors to:

determine that a second pixel of the bistable display is adjacent to the first pixel;

determine that the second pixel is to be set at a third target pixel state;

determine a difference between the first target pixel state and the third target pixel state; and apply a fourth voltage to the electrode associated with the second pixel based at least in part on the difference between the first target pixel state and the third target pixel state, wherein the difference corresponds to a level of contrast between the first pixel and the second pixel.

9. The system of claim 1, wherein the first voltage includes at least a positive voltage and a negative voltage, and wherein the first target pixel state is associated with a grayscale value between black and white.

10. A method comprising:

determining a first target pixel state for a first pixel of a bistable display, the first target pixel state associated with electronic content to be presented on the bistable display;

applying a first voltage to a first electrode associated with the first pixel to transition the first pixel to the first target pixel state, the first voltage applied for a first duration;

ceasing an application of the first voltage to the first electrode upon the first pixel reaching the first target pixel state;

applying a second voltage to the first electrode to maintain the first pixel at the first target pixel state;

determining that a second pixel of the bistable display is adjacent to a third pixel of the bistable display, the second pixel and the third pixel associated with presenting the electronic content on the bistable display;

determining a second target pixel state associated with the second pixel;

determining a third target pixel state associated with the third pixel;

determining that the second target pixel state is a same as the third target pixel state;

applying a third voltage to the second pixel to drive the second pixel to the second target pixel state, the third voltage applied for a second duration; and applying a fourth voltage to the third pixel to drive the third pixel to the third target pixel state, the fourth voltage applied for the second duration, wherein the second duration is longer than the first duration.

11. The method of claim 10, further comprising, prior to applying the first voltage:

determining that the first target pixel state is above a darkness threshold and apply the first voltage having a first polarity; or determining that the first target pixel state is below a lightness threshold and apply the first voltage having a second polarity that is opposite the first polarity.

12. The method of claim 10, further comprising:

applying the second voltage to the electrode associated with the first pixel following a predetermined amount of time following application of the first voltage; and applying a fifth voltage to the electrode associated with the first pixel to maintain the first pixel at the first target pixel state, the fifth voltage being applied to the electrode associated with the first pixel following the predetermined amount of time.

13. The method of claim 10, further comprising:

determining that a fourth pixel of the bistable display is adjacent to the first pixel;

determining that the fourth pixel is to be set at a fourth target pixel state;

determining that the fourth target pixel state is below a darkness threshold and above a lightness threshold; and applying a fifth voltage to the fourth pixel based at least in part on the fourth target pixel state being below the darkness threshold and above the lightness threshold, wherein a first duration of the fifth voltage is longer than a second duration of the first voltage.

14. The method of claim 10, wherein the electronic content is a first electronic content, and wherein the method further comprises:

receiving an input to navigate to a second electronic content;

determining a fourth target pixel state corresponding to the first pixel, the fourth target pixel state presenting at least a portion of the second electronic content in the bistable display;

determining a difference between the first target pixel state and the fourth target pixel state; and selecting, based at least in part on the difference, a fifth voltage to apply to the first electrode associated with the first pixel to transition the first pixel to the fourth target pixel state.

15. The method of claim 10, further comprising:

determining that a fourth pixel of the bistable display is adjacent to the first pixel;

determining that the fourth pixel is to be set at a fourth target pixel state;

determining a difference between the first target pixel state and the fourth target pixel state; and applying a fifth voltage to an electrode associated with the fourth pixel based at least in part on the difference between the first target pixel state and the fourth target pixel state, wherein the difference corresponds to a level of contrast between the first pixel and the fourth pixel.

16. The method of claim 10, wherein:

the first target pixel state is associated with a grayscale value between black and white; and the first voltage includes a first portion representing a positive voltage and a second portion representing a negative voltage.

17. An electronic book (eBook) reader device comprising:

an electronic ink display;

one or more processors; and one or more computer readable media storing computer-executable instructions that, when executed by the one or more processors, cause the one or more processors to:

determine a first target pixel state for a pixel of a bistable display, the first target pixel state associated with a first electronic content to be presented on the bistable display;

apply a first voltage to an electrode associated with the pixel to transition the pixel to the first target pixel state;

cease an application of voltage to the bistable display upon the pixel reaching the first target pixel state;

apply a second voltage to the electrode associated with the pixel to maintain the pixel at the first target pixel state;

receive an input to navigate to a second electronic content;

determine a second target pixel state corresponding to the pixel, the second target pixel state presenting at least a portion of the second electronic content in the bistable display;

determine a difference between the first target pixel state and the second target pixel state; and select, based at least in part on the difference, a third voltage to apply to the pixel to transition the pixel to the second target pixel state.

18. The eBook reader device of claim 17, wherein to apply the first voltage, the computer-executable instructions further cause the one or more processors to:

determine that the first target pixel state is above a darkness threshold and apply the first voltage having a first polarity; or determine that the first target pixel state is below a lightness threshold and apply the first voltage having a second polarity that is opposite the first polarity.

19. The eBook reader device of claim 17, wherein the computer-executable instructions further cause the one or more processors to:

apply the second voltage to the electrode associated with the pixel following a predetermined amount of time following application of the first voltage; and apply a fourth voltage to the electrode associated with the pixel to maintain the pixel at the first target pixel state, the fourth voltage being applied to the electrode associated with the pixel following the predetermined amount of time.

20. The eBook reader device of claim 17, wherein application of the second voltage to maintain the pixel at the target state reduces ghosting associated with the pixel transitioning from a first value to a second value.

* * * * *